United States Patent [19]

Parks et al.

[11] Patent Number: 4,751,098

[45] Date of Patent: Jun. 14, 1988

[54] REOXIDATION OF PARTIALLY OXIDIZABLE POWDERS

[75] Inventors: Beryl H. Parks, Lexington; Nick W. Hille, Columbia, both of S.C.

[73] Assignee: Westinghouse Electric Corp., Pittsburgh, Pa.

[21] Appl. No.: 888,657

[22] Filed: Jul. 22, 1986

[51] Int. Cl.[4] ..... B05D 1/08

[52] U.S. Cl. ..... 427/6; 427/216; 427/399

[58] Field of Search ..... 427/6, 216, 399

[56] References Cited

U.S. PATENT DOCUMENTS

| | | | |
|---|---|---|---|
| 2,197,792 | 4/1940 | Erickson | 118/303 |
| 3,707,136 | 12/1972 | Kostas | 427/216 |
| 4,254,167 | 3/1981 | Sulzbacher et al. | 427/216 |
| 4,592,790 | 6/1986 | Globus | 427/216 X |

OTHER PUBLICATIONS

Uranium-233 Purification and Conversion to Stabilized Ceramic Grade Urania for LWBR Fabrication, Westinghouse Electric Corp. Oct. 1980.

*Primary Examiner*—Shrive P. Beck
*Attorney, Agent, or Firm*—A. Mich, Jr.

[57] ABSTRACT

Disclosed is a method of reoxidizing a partially oxidizable metal or metal oxide powder. The powder is spread on a first sloped trough to form a layer of less than about a half inch in thickness. The layer of powder slides down the trough and falls onto a second trough sloped in the opposite direction, thereby inverting the powder on the second trough. While the powder is on the troughs, it is exposed to an amount of oxygen sufficient to partially oxidize the powder but insufficient to completely oxidize the powder.

Also disclosed is apparatus useful for partially reoxidizing a partially oxidizable powder. The apparatus consists of a first enclosed trough sloped in one direction having a powder entrance and a powder exit, a second enclosed trough sloped in the opposite direction having a powder entrance positioned to accept powder from the powder exit of the first trough, the first and second troughs forming a sealed unit, means for emitting a gas into the troughs, means for cooling the powder, and means for vibrating the troughs.

15 Claims, 1 Drawing Sheet

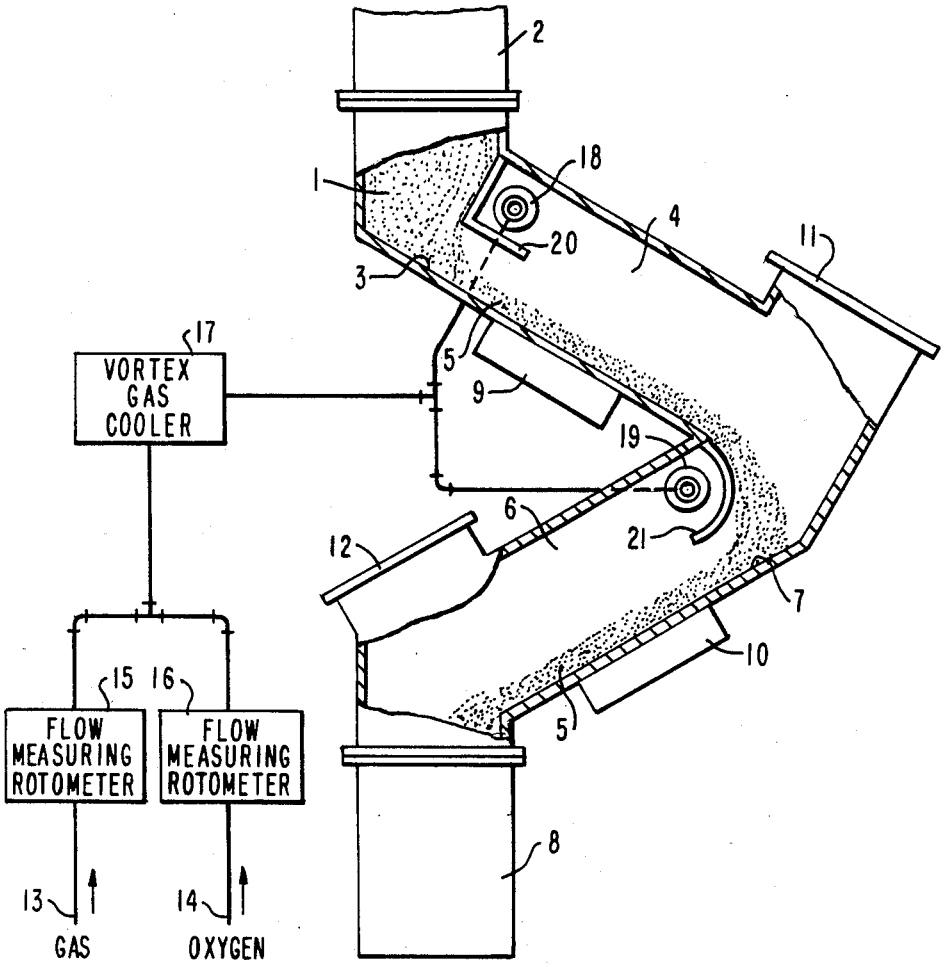
2
18
1
4
20
11
3
17
VORTEX GAS COOLER
5
9
19
6
21
12
7
10
15
16
FLOW MEASURING ROTOMETER
FLOW MEASURING ROTOMETER
5
8
13
14
GAS
OXYGEN

REOXIDATION OF PARTIALLY OXIDIZABLE POWDERS

BACKGROUND OF THE INVENTION

There are many oxides of uranium, including $UO_2$, $UO_3$, $U_3O_8$, and $U_4O_9$. When uranium dioxide powder is manufactured for use as fuel pellets in nuclear reactors, it can sometimes spontaneously oxidize to form an oxide containing more oxygen. This process, known as "burnback," liberates an undesirable amount of heat and reduces the ceramic activity of the powder, rendering it unusable without further treatment.

The likelihood that a powder will spontaneously oxidize depends upon the activity of a powder, which is primarily a function of its surface area and the oxygen-to-uranium (O/U) atomic ratio of the powder. A powder having a fine particle size (and therefore a large surface area), or having a low O/U ratio is more likely to spontaneously oxidize that is a coarser powder, or a powder with a higher O/U ratio.

Methods have been proposed for stabilizing uranium dioxide powder by partially reoxidizing the powder under controlled conditions to a slightly higher O/U ratio. These methods involve exposing the powder to a small amount of oxygen so that those particles that are most sensitive to spontaneous oxidation are oxidized to a more stable state. In some of these methods, the powder is fluidized in the presence of diluted oxygen. While this will stabilize the powder, it creates additional problems in that fluidized uranium dioxide powder is difficult to handle and must be carefully filtered to prevent the very fine particles from escaping into the atmosphere.

Another method of partially oxidizing uranium oxide powders is described by R. Lloyd in a paper entitled "Uranium 233 Purification and Conversion to Stabilized Ceramic Grade Urania for LWBR Fuel Fabrication (LWBR Development Program)," dated October, 1980, and available from the National Technical Information Service of the U.S. Department of Commerce. In Dr. Lloyd's processes, water is added to the powder to occpy the oxygen absorption sites on the particles. While this stabilizes the powder, it is unsuitable for use with enriched uranium where the uranium must be handled in bulk because water acts as a neutron moderator, generating large numbers of thermal neutrons which can cause the powder to become critical.

SUMMARY OF THE INVENTION

We have discovered a process for partially reoxidizing a partially oxidizable powder that does not involve fluidizing the powder and does not involve the addition of water or moisture to the powder. In the process of this invention, fluidization of a powder is avoided by sliding a thin layer of a powder down a trough and permitting it to fall upon a trough sloped in the opposite direction, which inverts the layer of powder. Oxygen partially oxidizes the powder as it flows down the two troughs. The method and apparatus of this invention are inexpensive to construct and operate because extensive powder filtering facilities are not required.

Another advantage of the invention is that pulsing is avoided. Pulsing is a condition that occurs when the temperture of the powder increases, causing the powder to oxidize at a faster rate which further increases the temperature until burnup occurs. Pulsing is avoided in the process and apparatus of this invention because the powder is thinly spread and the oxygen concentration is kept low.

DESCRIPTION OF THE INVENTION

The accompanying drawing is a side view in section showing a certain presently preferred embodiment of an apparatus for partially oxidizing a powder according to this invention.

In the drawing, the powder to be reoxidized 1 falls from a processing facility 2, such as a Fitzmill, onto the flat bottom 3 of enclosed trough 4, forming a layer of powder 5. Sealed to trough 4 is a second enclosed trough 6 having flat bottom 7. As the layer of powder 5 falls from trough 4 onto trough 5, it is inverted. Movement of the powder down troughs 4 and 6 to exit 8 is aided by vibrators 9 and 10, respectively. Trough 6 is provided with porous plate exit filters 11 and 12 for exhausting gases into a conventional filtration system (not shown). Nitrogen or other inert gas 13 and oxygen 14 pass through mass flow measuring rotometers 15 and 16, respectively, which permit their mixture in the desired proportions. A vortex gas cooler 17 cools the gas mixture before it is admitted to nozzles 18 and 19, where the gas mixture is directed against baffles 20 and 21, respectively, to avoid agitating the powder.

Powders that can be treated by the process of this invention are those that are partially oxidizable, that is, powders which, when exposed to oxygen, do not completely oxidize but can be oxidized to form a stable oxide that is less than completely oxidized. Such powders include various metal elements such as, for example, rhodium, tungsten, nickel, manganese, cobalt, iron, and mixtures and alloys thereof, as well as oxides of various metals. Alkali metals or alkaline earth metals cannot be used because they cannot be only partially oxidized. The invention is particularly directed at oxides of uranium and plutonium, and particularly uranium, as spontaneous oxidation is a problem of some concern in the preparation of $UO_2$ powders. However, spontaneous oxidation can also occur in the processing of many other metal powders. Uranium dioxide powder admitted to the apparatus of this invention can come from the outlet line of a mill such as a Fitzmill (a type of hammer mill), a blender, or from another facility. Uranium dioxide that has been prepared by the ammonium diuranate process or by the indirect dry route, or by other routes, can be used in the process and apparatus of this invention.

The powder is preferably cooled while it is in contact with the oxygen because its propensity to burnback increases with temperature. Therefore, once burnback begins, it becomes self-perpetuating. Cooling can be accomplished, for example, by using a cooled gas mixture or by cooling the trough. If a compressed inert gas is available, it is preferably to use a vortex cooler as that is an efficient way of cooling the powder.

The powder should be admitted to the first trough at a rate such as to deposit a layer of powder less than about ½ inch thick. If the layer of powder is thicker than about ½ inch, the top of the powder and the bottom or middle of the powder may have different characteristics. Preferably, the layer of powder should be about ⅛ to about ¼ inch thick. The powder is exposed to an amount of oxygen sufficient to partially reoxidize the powder but insufficient to completely oxidize the powder. The amount of oxygen necessary to accomplish this will depend upon the amount of powder that is present and its present state of oxidation as well as upon the temperature of the powder, the oxygen concentration, the time that the powder is exposed to the oxygen, and the flow rate of the oxygen over the powder.

For a uranium dioxide powder, an oxygen concentration of about 0.25 to about 4% (by volume based on total gas mixture volume) in an inert gas (such as nitrogen or argon) works well, as higher concentrations may cause a burnback in the trough. A residence time for exposure to the oxygen of about 10 seconds to about 15 minutes is usually adequate. The residence time can be controlled by the slope of the troughs, the length of the troughs, and the amplitude and frequency with which the troughs are vibrated. The temperature can vary between ambient temperature (about 25° C.) to about 150° C. Higher temperatures should not be used for $UO_2$ powder because the rate of oxidation increases with temperature and higher temperatures may lead to burnback. The amount of oxygen present can be, for example, about 50 to about 200% in excess of the amount of stoichiometrically required to reoxidize the powder the desired amount.

If the powder is freshly manufactured uranium dioxide powder, all of the uranium dioxide powder produced may be treated by the process of this invention, rather than treating only that powder which is particularly susceptible to burnup because of its low O/U atomic ratio. Because it is difficult to monitor the exact O/U ratio of the powder and use that parameter to control, for example, the oxygen-to-nitrogen ratio, and because the reoxidation caused by the process of this invention is not likely to be harmful, it may be advantageous to simply reoxidize all the powder. Generally speaking, if the $UO_2$ powder has an O/U atomic ratio of less than 2.1, it is desirable to reoxidize the powder according to the process of this invention to increase the U/O ratio by about 0.01 to about 0.06 so that the powder's susceptibility to burnback is reduced to a safe level.

What is claimed is:

1. A method of reoxidizing a partially oxidizing metal or metal oxide powder comprising, without adding water or moisture to said powder, (1) spreading said powder on a first sloped trough to form a layer less than about ½ inch in thickness;

(2) vibrating said first sloped trough to cause said layer of powder to slide theredown;

(3) permitting said layer to fall off said first sloped trough onto a second trough sloped in the opposite direction, whereby said layer is inverted onto said second trough;

(4) vibrating said second sloped trough to cause said layer of powder to slide theredown; and (5) while said powder is sliding down said troughs, exposing said powder to oxygen sufficient to partially oxidize said powder, but insufficient to completely oxidize said powder.

2. A method according to claim 1 wherein said powder has the approximate formula $UO_2$.

3. A method according to claim 2 wherein said powder has an oxygen-to-uranium atomic ratio of less than about 2.1 and said ratio is raised by about 0.01 to about 0.06 by exposure to said oxygen.

4. A method according to claim 1 wherein said powder is cooled when exposed to said oxygen.

5. A method according to claim 1 wherein said oxygen is mixed with an inert gas.

6. A method according to claim 5 wherein said mixture of gases is cooled using a vortex cooler.

7. A method according to claim 5 wherein said inert gas is nitrogen.

8. A method according to claim 1 wherein said layer is about ⅛ to about ¼ inches thick.

9. A method according to claim 1 wherein said oxygen is mixed with an inert gas at a concentration of about 0.25 to about 4% oxygen.

10. A method according to claim 1 wherein said exposure of said powder to said oxygen is for about 10 seconds to about 15 minutes.

11. A method according to claim 1 wherein the temperature of said powder is maintained at about 25° to about 150° C..

12. A method according to claim 1 wherein the amount of oxygen said powder is exposed to is about 50 to about 200% in excess of stoichiometric.

13. A method according to claim 1 wherein the bottoms of said troughs are flat.

14. A method of reoxidizing a partially oxidizable metal or metal oxide powder without adding water or moisture to said powder comprising sliding a layer of said powder less than about ½ inch in thickness down a multiplicity of oppositely sloped vibrating troughs, whereby said sliding powder is inverted as it moves from one trough to another, while exposing said sliding powder to oxygen sufficient to partially oxidize said powder, but insufficient to completely oxidize said powder.

15. A method of reoxidizing a partially oxidizable $UO_2$ powder having an oxygen-to-uranium atomic ratio of less than about 2.1 without adding water or moisture to said powder comprising sliding a layer of said powder about ⅛ top about ¼ inch thick down a multiplicity of oppositely sloped vibrating troughs at a temperature of about 25° to about 150° C., whereby said sliding powder is inverted as it moves from one trough to another, while exposing said sliding powder to a mixture of about 0.25 to about 4% oxygen in nitrogen for about 10 seconds to about 15 minutes, whereby said oxygen-to-uranium atomic ratio is raised by about 0.01 to about 0.06.

* * * * *